US005565731A

United States Patent [19]

Han

[11] Patent Number: 5,565,731

[45] Date of Patent: Oct. 15, 1996

[54] CATHODE RAY TUBE

[75] Inventor: Yu-cheol Han, Kwacheon, Rep. of Korea

[73] Assignee: Samsung Electron Devices Co., Ltd., Kyungki-do, Rep. of Korea

[21] Appl. No.: 400,294

[22] Filed: Mar. 6, 1995

Related U.S. Application Data

[63] Continuation-in-part of Ser. No. 34,433, Mar. 19, 1993, abandoned.

[30] Foreign Application Priority Data

Aug. 12, 1992 [KR] Rep. of Korea ..... 92-14461

[51] Int. Cl.[6] ..... H01J 29/00; H01J 31/00

[52] U.S. Cl. ..... 313/440; 313/477 R; 313/364

[58] Field of Search ..... 313/440, 441, 313/477 R, 413, 364; 220/2.1 R, 2.3 R, 2.3 A

[56] References Cited

U.S. PATENT DOCUMENTS 4,427,917 1/1984 Mizushima et al. .
4,631,439 12/1986 D'Amato et al. ..... 313/477 R
5,059,858 10/1991 Shimoma et al. .
5,121,028 6/1992 Milili .
5,177,399 1/1993 Fujiwara et al. .

FOREIGN PATENT DOCUMENTS 0024726 3/1978 Japan ..... 313/440

*Primary Examiner*—Michael Horabik
*Assistant Examiner*—Nimeshkumar D. Patel

[57] ABSTRACT

Disclosure is related to a cathode ray tube including a panel forming a fluorescent layer therein, and a funnel connected to a panel and including an electron gun and a deflection yoke mounted inside and near the neck portion thereof, respectively, which satisfies the following equation:

$$\theta RL = 1 \text{ to } 1.3$$

where θ denotes a deflection angle in degrees of an electron beam emitted from the electron gun, and RL denotes the distance in millimeters between the outlet of the electron gun mounted in the neck portion and the reference line which is the boundary between the deflection region where the electron beam emitted from the electron gun is deflected by the deflection yoke and the linear region where the electron beam moves linearly. The cathode ray tube can prevent the electron beam emitted from the electron gun from colliding with the inner surface of the funnel and mislanding in the corner areas of the fluorescent layer.

4 Claims, 2 Drawing Sheets

CATHODE RAY TUBE

This application is a continuation in part of application Ser. No. 08/034,433 filed Mar. 19, 1993, now abandoned.

BACKGROUND OF THE INVENTION

The present invention relates to a cathode ray tube, and more particularly to a cathode ray tube which prevents the mislanding of the electron beam emitted from an electron gun and intended for the corner areas of a fluorescent layer, which occurs after colliding with the inner surface of the funnel.

Generally, a cathode ray tube as shown in FIG. 1, comprises a panel 10 on whose inner surface is formed a fluorescent layer 11, and a funnel 20 connected to panel 10 and including an electron gun 22 mounted inside a neck portion 21 and a deflection yoke 23 installed around the cone portion near the neck portion 21. In the cathode ray tube of FIG. 1, an electron beam emitted from the outlet G of the final accelerating electrode of electron gun 22 is deflected by deflection yoke 23 according to the scanning position on fluorescent layer 11, to land on fluorescent layer 11 and thus form a pixel; many such pixels are gathered to form a picture. However, since the screen is highly minute and elongated in the horizontal direction, the deflection angle is enlarged, so that the electron beam emitted from electron gun 22 collides with the inner surface of funnel 20 and cannot be precisely landed on the corner areas of fluorescent layer 11. The collision against the inner surface of funnel 20 by the electron beam emitted from electron gun 22 and intended for the corner areas of fluorescent layer 11, is due to the shape of funnel 20, installation conditions of deflection yoke 23, positioning of electron gun 22 and deflection yoke 23, etc. If, to solve the above problems, the cone portion near the neck of funnel 20 is formed such that it is large enough for the electron beam to avoid the above-described collision, the cathode ray tube must be enlarged accordingly, which necessitates that each part thereof be designed differently. Particularly, a cathode ray tube so enlarged significantly increases the process time required to adequately vacuumize its interior.

SUMMARY OF THE INVENTION

It is an object of the present invention to provide a cathode ray tube which prevents the electron beam emitted from an electron gun from colliding with the inner surface of cone portion of a funnel to subsequently misland, when intended for the corner areas of a fluorescent layer.

To achieve the above object of the present invention, there is provided a cathode ray tube comprising a panel formed with a fluorescent layer therein, and a funnel connected to the panel and provided with an electron gun and a deflection yoke mounted inside and near the neck portion thereof, respectively, which satisfies the following equation:

$$\frac{\theta}{\text{distance between } G \text{ and } R} = \beta$$

where θ denotes a deflection angle of an electron beam emitted from the electron gun, G denotes the outlet of the final accelerating electrode of the electron gun mounted in the neck portion, and R denotes the reference line which is the boundary between the deflection region where the electron beam emitted from the electron gun is deflected and curved by the deflection yoke and the linear region where the electron beam moves linearly.

BRIEF DESCRIPTION OF THE DRAWINGS

Further features and advantages will become more apparent from the following and more particular description of the preferred embodiment of the invention as illustrated in the accompanying drawings in which the same reference characters generally refer to like parts throughout the views, and in which.

DETAILED DESCRIPTION OF THE INVENTION

Figure 1:
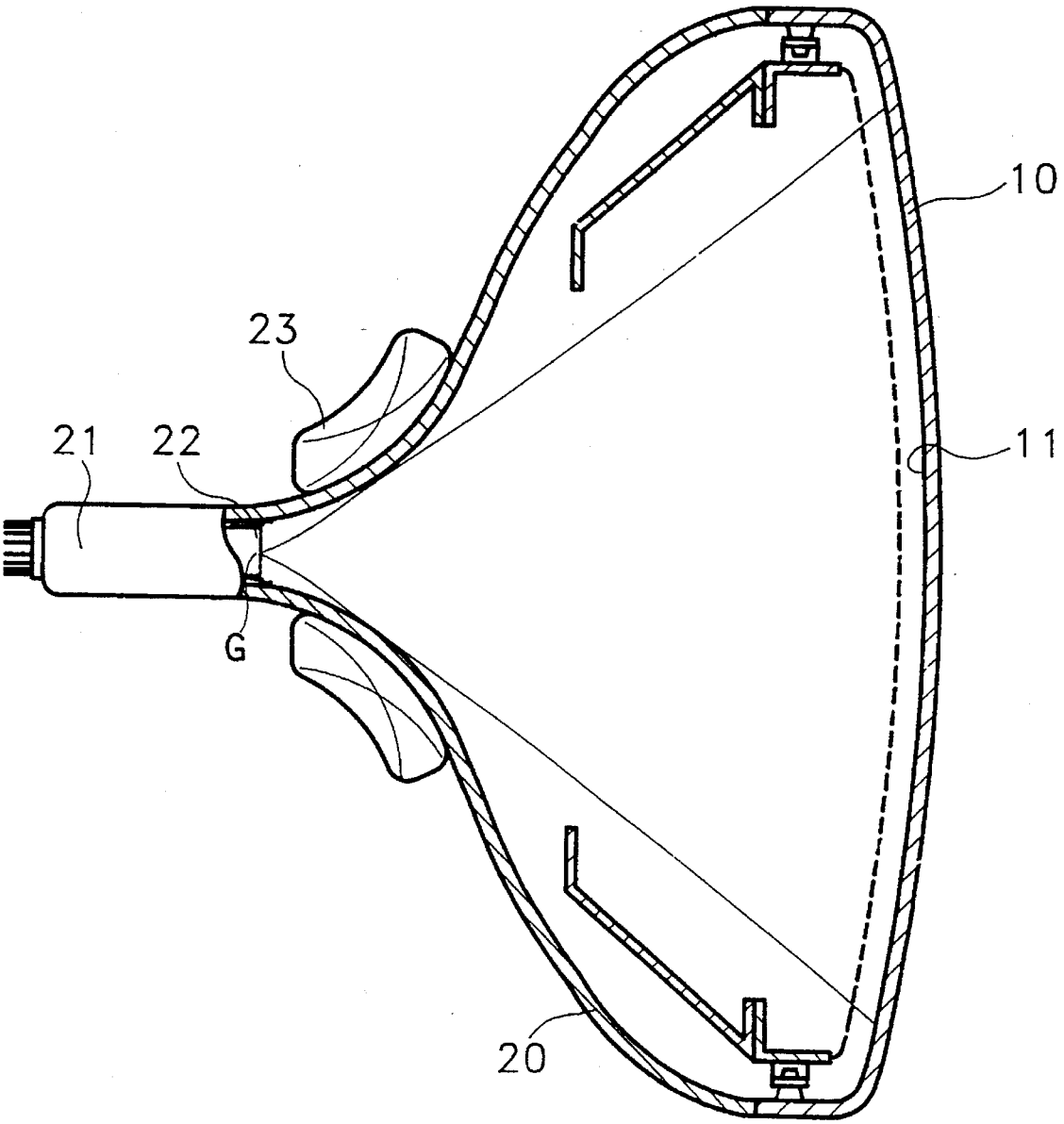
FIG. 1 (PRIOR ART)
FIG. 1 is a cut-away side view of a conventional cathode ray tube.
Figure 2:
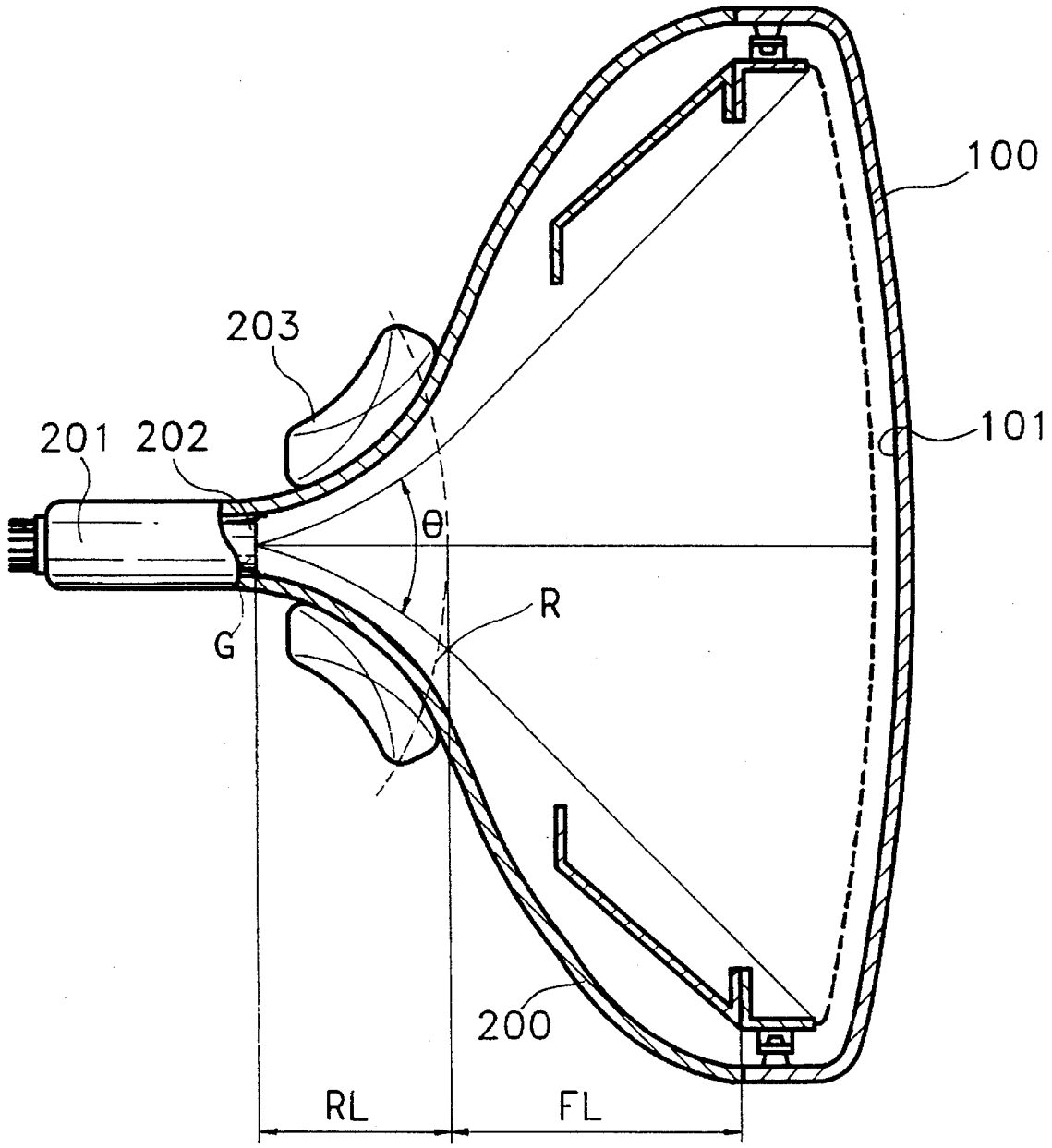
FIG. 2 is a cut-away side view of a cathode ray tube according to the present invention.

As shown in FIG. 2, a cathode ray tube generally comprises a panel 100 on whose interior surface is formed a fluorescent layer 101, and a funnel 200 connected to panel 100 and provided with an electron gun 202 mounted inside a neck portion 201 and a deflection yoke 203 installed around the cone portion near the neck portion which deflects the electron beam emitted from electron gun 202 according to the scanning position of fluorescent layer 101. In the cathode ray tube constructed as above, as the CRT size is enlarged and the screen becomes elongated in the horizontal direction, the deflection angle of the electron beam emitted from the outlet of the final accelerating electrode of electron gun 202 becomes large. At this time, the electron beam emitted from electron gun 202 collides with the inner surface of cone portion of funnel 200 and cannot be precisely landed on the corner areas of fluorescent layer 101, so that the picture of the corner areas is not clear. The inventor has studied the causes of the above problems (i.e., why the electron beam emitted from the electron gun cannot be precisely landed on the corner areas of the fluorescent layer), and found the following contributing factors to such a phenomenon: (1) the installation conditions of the deflection yoke and the magnitude of the deflection angle; (2) the eccentric distance between the centers of the electron beam passing holes of three electron guns emitting electron beams of red, blue and green, respectively; and (3) the distance between the outlet of the last accelerating electrode and a reference line R which is the boundary between the deflection region (where the electron beam emitted from the electron gun is deflected and curved by the deflection yoke) and the linear region (where the electron beam moves linearly).

Accordingly, in order to prevent the electron beam emitted from the electron gun from colliding with the inner surface of the cone portion and mislanding on the corner areas of the fluorescent layer, the inventor formulated the below equation in respect to the above reasons, and experimented to extract the results shown in Tables 1 and 2.

$$(FL/RL)\times(\theta/S)=\alpha$$

where FL denotes the distance in millimeters from the edge of the funnel to the reference line R, RL denotes the distance in millimeters between the outlet of the last accelerating electrode and the reference line R, θ denotes the deflection angle in degrees of the electron beam emitted from the electron beam, and S denotes the eccentric distance in millimeters between centers of electron beam passing holes of electrodes constituting the electron gun.

TABLE 1

| deflection angle (θ) | RL | FL | S | α | generation of BSC* |
|---|---|---|---|---|---|
| 110° | 60 | 190 | 7.0 | 4.96 | x |
| 110° | 70 | 190 | 7.0 | 5.79 | Δ |
| 110° | 80 | 190 | 7.0 | 6.62 | ○ |
| 110° | 90 | 190 | 7.0 | 7.44 | ○ |
| 110° | 60 | 200 | 7.0 | 4.71 | x |
| 110° | 70 | 200 | 7.0 | 5.50 | Δ |
| 110° | 80 | 200 | 7.0 | 6.29 | ○ |
| 110° | 90 | 200 | 7.0 | 7.07 | ○ |
| 110° | 60 | 210 | 7.0 | 4.49 | x |
| 110° | 70 | 210 | 7.0 | 5.24 | Δ |
| 110° | 80 | 210 | 7.0 | 5.99 | Δ |
| 110° | 90 | 210 | 7.0 | 6.73 | ○ |
| 110° | 60 | 220 | 7.0 | 4.29 | x |
| 110° | 70 | 220 | 7.0 | 5.00 | Δ |
| 110° | 80 | 220 | 7.0 | 5.71 | Δ |
| 110° | 90 | 220 | 7.0 | 6.43 | ○ |

*beam struck cone
○: BSC is not generated
Δ: about 20% BSC generation
x: BSC is generated

TABLE 2

| deflection angle (θ) | RL | FL | S | α | generation of BSC* |
|---|---|---|---|---|---|
| 106° | 50 | 180 | 5.6 | 5.26 | Δ |
| 106° | 60 | 180 | 5.6 | 6.30 | Δ |
| 106° | 70 | 180 | 5.6 | 7.36 | ○ |
| 106° | 80 | 180 | 5.6 | 8.42 | ○ |
| 106° | 50 | 190 | 5.6 | 4.98 | Δ |
| 106° | 60 | 190 | 5.6 | 5.98 | Δ |
| 106° | 70 | 190 | 5.6 | 6.97 | ○ |
| 106° | 80 | 190 | 5.6 | 7.97 | ○ |
| 106° | 50 | 200 | 5.6 | 4.73 | Δ |
| 106° | 60 | 200 | 5.6 | 5.68 | Δ |
| 106° | 70 | 200 | 5.6 | 6.66 | ○ |
| 106° | 80 | 200 | 5.6 | 7.57 | ○ |
| 106° | 50 | 210 | 5.6 | 4.50 | Δ |
| 106° | 60 | 210 | 5.6 | 5.40 | Δ |
| 106° | 70 | 210 | 5.6 | 6.31 | ○ |
| 106° | 80 | 210 | 5.6 | 7.21 | ○ |

*beam struck cone
○: BSC is not generated
Δ: about 20% BSC generation
x: BSC is generated As shown in Tables 1 and 2, this phenomenon, wherein the electron beam emitted from electron gun 202 collides with the inner neck portion, is closely related to a distance RL between the outlet of the last accelerating electrode of electron gun 202 and reference line R which is the boundary between the deflection region and the linear region of the electron beam, while having less correlation with an eccentric distance S and a distance FL between the reference line R and the edge of panel 101.

Accordingly, the applicant formulated the below equation, with reference to the above tables, and experimented to extract the results shown in Table 3.

$$\theta/RL=\beta$$

where θ denotes the deflection angle in degrees of an electron beam, and RL denotes the distance in millimeters between the outlet of the last accelerating electrode and reference line R.

TABLE 3

| θ | RL | β | generation of BSC* |
|---|---|---|---|
| 110° | 70 | 1.57 | x |
| 110° | 80 | 1.38 | Δ |
| 110° | 90 | 1.22 | ○ |
| 110° | 100 | 1.10 | ○ |
| 106° | 50 | 2.12 | x |
| 106° | 60 | 1.77 | x |
| 106° | 70 | 1.50 | Δ |
| 106° | 80 | 1.33 | ○ |
| 106° | 90 | 1.18 | ○ |

*beam struck cone
○: BSC is not generated
Δ: about 20% BSC generation
x: BSC is generated As shown in Table 3, when the value of β (satisfying the above equation) is between 1 and 1.3, an enlarged deflection angle of the electron beam emitted from the electron gun is optimized so that the electron beam does not collide with the inner surface of the funnel, and the image is clearly formed in the corner areas of fluorescent layer. This is accomplished without enlarging the interior volume of the funnel.

Therefore, in the cathode ray tube of the present invention, as the deflection angle of the electron beam emitted from the electron gun may be enlarged as the screen becomes elongated in the horizontal direction, which may result in the electron beam emitted from the electron gun colliding with the inner surface of the funnel and thus not being precisely landed on the corner areas of the fluorescent layer, the funnel can be optimally designed without increasing its interior volume.

What is claimed is:

1. A cathode ray tube comprising a panel forming a fluorescent layer therein, and a funnel connected to said panel and including an electron gun and a deflection yoke mounted inside and near the neck portion thereof, respectively, which satisfies the following equation:

$$\theta/RL=1 \text{ to } 1.3$$

where θ denotes a deflection angle in degrees of an electron beam emitted from said electron gun, and RL denoted a distance in millimeters between an outlet of the electron gun mounted in said neck portion and a reference line which is a boundary between the deflection region where the electron beam emitted from said electron gun is deflected and curved by said deflection yoke and the linear region where the electron beam moves linearly.

2. A cathode ray tube having a panel formed with a fluorescent layer therein, a funnel connected to said panel, said funnel having a cone shaped portion and a neck shaped portion, an electron gun mounted in said neck shaped portion, and a deflection yoke mounted near said neck shaped portion and proximate said cone shaped portion, wherein an electron beam emitted from said electron gun tends to collide with an inner surface of said cone shaped portion at enlarged deflection angles, the cathode ray tube comprising:

means for optimizing a deflection angle of said electron beam so that said deflection angle is the maximum angle at which said electron beam does not collide with the inner surface of said cone shaped portion, said means including, first means for establishing a deflection region for said electron beam, said deflection region having a boundary, and second means for establishing a predetermined relationship between said deflection angle and a parameter associated with said boundary.

3. A cathode ray tube according to claim 2, wherein said parameter associated with said boundary is a distance between the electron gun and the boundary.

4. A cathode ray tube according to claim 3, wherein the predetermined relationship is a range of ratios between said maximum deflection angle in degrees and said distance in millimeters.

* * * * *